United States Patent [19]

Chiba et al.

[11] Patent Number: 4,903,673

[45] Date of Patent: Feb. 27, 1990

[54] IGINITION DISTRIBUTOR FOR AN INTERNAL COMBUSTION ENGINE

[75] Inventors: Masaaki Chiba; Hideki Maruhashi; Yutaka Ohashi; Shigemi Murata; Hidetoshi Miyaji, all of Himeji, Japan

[73] Assignee: Mitsubishi Denki Kabushiki Kaisha, Tokyo, Japan

[21] Appl. No.: 223,504

[22] Filed: Jul. 25, 1988

[30] Foreign Application Priority Data

Jul. 24, 1987 [JP] Japan ..... 62-185933
Jul. 24, 1987 [JP] Japan ..... 62-114006[U]
Jul. 24, 1987 [JP] Japan ..... 62-114007[U]

[51] Int. Cl.[4] ..... F02P 7/073
[52] U.S. Cl. ..... 123/617; 123/146.5 A
[58] Field of Search ..... 123/146.5 A, 418, 420, 123/617

[56] References Cited

U.S. PATENT DOCUMENTS 4,401,066 8/1983 Brand et al. ..... 123/617 X
4,677,946 7/1987 Tamagne ..... 123/617 X
4,808,934 2/1989 Yokoyama et al. ..... 123/617 X

FOREIGN PATENT DOCUMENTS 0027056 7/1972 Japan .
0169283 10/1986 Japan .
8500081 1/1985 World Int. Prop. O. ..... 123/617

*Primary Examiner*—Willis R. Wolfe
*Attorney, Agent, or Firm*—Sughrue, Mion, Zinn, Macpeak & Seas

[57] ABSTRACT

This invention relates to an ignition distributor for an internal combustion engine and more specifically relates to a novel reluctor included in an ignition distributor for discriminating between cylinders of an engine. The reluctor has an elongated shape and is arranged relative to the rotating shaft of an ignition distributor so that the gravity center of the reluctor is located exactly on the rotational axis of the shaft. This arrangement enables the rotational movement of the shaft to be concentrated, so that the wear to which the bearings supporting the shaft is subjected is significantly reduced. The reluctor is attached to the governor base of an ignition distributor without any rivets by virtue of the novel configuration thereof, so that a reduction in the number of parts can be achieved, together with reduction in the total production cost.

5 Claims, 4 Drawing Sheets

IGNITION DISTRIBUTOR FOR AN INTERNAL COMBUSTION ENGINE

TECHNICAL FIELD

This invention relates to an ignition distributor for an internal combustion engine, and more specifically relates to a reluctor included in an ignition distributor for discriminating between the cylinders of an internal combustion engine.

BACKGROUND ART

Shown in FIG. 1 is a typical ignition distributor of the conventional type. In FIG. 1, a numeral 1 denotes a housing of the ignition distributor, numeral 2 denotes a cap connected to the housing 1, numeral 3 denotes a shaft adapted to be rotated by an internal combustion engine, numeral 4 denotes a spark-advance sleeve into which the shaft 3 is loosely fitted, numeral 5 denotes a reluctor provided on the spark-advance sleeve 4 and cooperating with a stator 6 to detect an ignition timing, numeral 7 denotes a magnet signal type generator for generating an ignition signal for each of the cylinders of an engine and numeral 8 denotes an ignition-timing control unit for processing the ignition signal generated by the magnet signal type generator 7 in response to the close relationship between the reluctor 5 and the stator 6.

A numeral 9 denotes a centrifugal spark-advance controller comprising a governor base 91 fixed to the shaft and weights 92 carried on the governor base 91 by means of weight holding pins 95 (see FIG. 3). Each of the weights 92 is engaging with a centrifugal spark-advance plate 94 through a spark-advance pin 96 provided for each of the weights 92.

Fixed to the governor base 91 by way of rivets 50 is a reluctor 10 for discriminating between the cylinders of an internal combustion engine, which rotates with the shaft 3 and cooperates with a sensor 11 that generates a signal for discriminating between the cylinders of an internal combustion engine in response to the rotation of the reluctor 10, in other words, in response to the rotation of the shaft 3. The sensor 11 is attached to the outer circumferential surface of the housing 1 in such a manner that the sensing surface 111 of the sensor 11 is exposed in the housing 1 and that the work end 100 of the reluctor 10 passes by the exposed sensing surface 111.

As shown in FIG. 2, the reluctor 10 has two openings 101 therein through which the rivets 50 extend such as to fix the reluctor 10 to the governor base 91 so that the reluctor 10 rotates with the governor base 91 in response to the rotation of the shaft 3. The reluctor 10 also has an unloaded opening 102 therein through which the weight holding pin 93 extends, as shown in FIG. 3.

In an engine having four cylinders, the shaft 3 makes one rotation for every two rotations of a crank shaft (not shown) of the engine and four ignition signals are output and one cylinder discriminating signal is output during each rotation of the shaft 3. Detection of a reference cylinder is achieved by using the cylinder discriminating signal from the sensor 11 and on the basis of the result of this detection, a signal is supplied to a fuel injecting device to inject fuel to the corresponding cylinder when the valve thereof is opened.

The conventional ignition distributor described above suffers from the following problems. In the conventional ignition distributor, the reluctor 10 is arranged to be biased away from the rotational axis, which results in affecting the concentration of the rotational movement of the shaft 3. Consequently, the bearings of the housing 1 supporting the shaft 3 are subjected to wear to a significant extent.

Furthermore, the rivets 50 are needed in the conventional ignition distributor in order to fix the reluctor 10 to the governor base 91, which causes an increase in the number of parts required to construct the product.

DISCLOSURE OF THE INVENTION

The object of this invention is therefore to provide an ignition distributor which can achieve exact concentration of the rotational movement of the rotating members of an ignition distributor.

Another object of this invention is to provide an ignition distributor which consists of fewer parts than the conventional one.

In one aspect of this invention, an ignition distributor in accordance with this invention comprises a shaft rotated by an engine, a reluctor for discriminating between the cylinders of the engine which is adapted to rotate in response to the rotation of the shaft, and a sensor that cooperates with the reluctor to generate a signal for discriminating between the cylinders of the engine, the ignition distributor being characterized in that the gravity center of the reluctor is on the rotational axis of the shaft. The reluctor is so arranged that the presence of the reluctor has no influence on the concentration of the rotational movement of the rotating member of the ignition distributor.

In another aspect of this invention, an ignition distributor in accordance with this invention comprises:

- a shaft rotated by the engine;
- a reluctor for discriminating between the cylinders of an engine which is adapted to rotate in response to the rotation of the shaft;
- a sensor that cooperates with the reluctor to generate a signal for discriminating between the cylinders of the engine; and
- a centrifugal spark-advance controller including a governor base fixed to the shaft and supporting the reluctor, and weights carried on the governor base by means of weight holding pins extending through the governor base.
- the ignition distributor being characterized in that the reluctor is fixed to the governor base by the spark-advance pin. Rivets are no longer needed to fix the reluctor to the governor base, so that it is expected that a reduction in the total number of parts and, hence, in the production costs can be achieved.

In another aspect of this invention, the reluctor is caulked to the shaft with the governor base.

BRIEF DESCRIPTION OF THE DRAWINGS

The present invention will be described hereinunder in detail by way of preferred embodiments and with reference to the accompanying drawings, wherein.

BEST MODE FOR CARRYING OUT THE INVENTION

Figure 1:
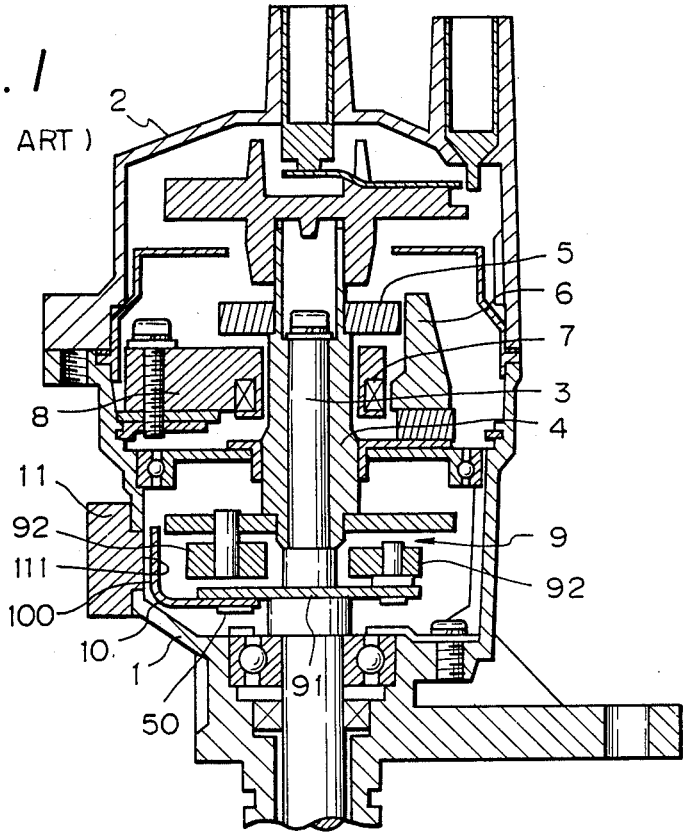
Fig. 1 (PRIOR ART)
FIG. 1 is a longitudinal cross-sectional view of a conventional ignition distributor.
Figure 4:
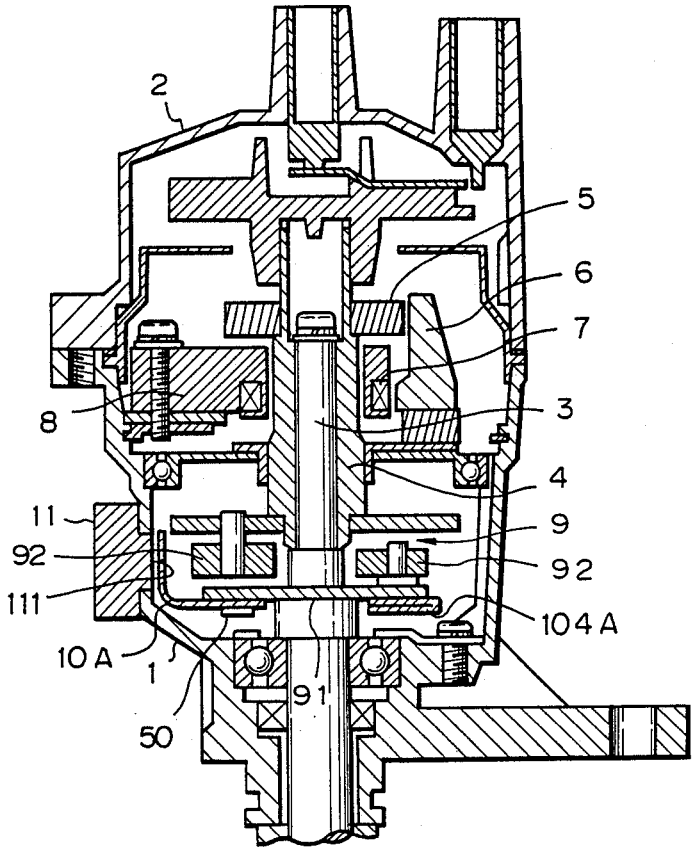
FIG. 4 is a longitudinal cross-sectional view of an ignition distributor in accordance with this invention.

Shown in FIG. 4 is an ignition distributor in accordance with this invention. Those components which correspond to the components identified above with reference to FIG. 1 are identified by the same reference number.

Figure 2:
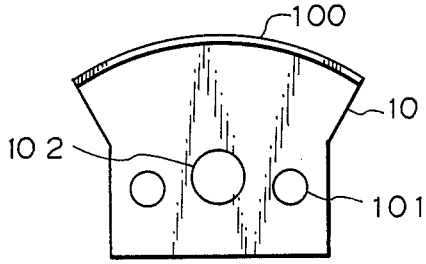
Fig. 2 (PRIOR ART)
FIG. 2 is a plane view of a reluctor for discriminating between the cylinders of an internal combustion engine, which is used for a conventional ignition distributor as illustrated in FIG. 1.
Figure 3:
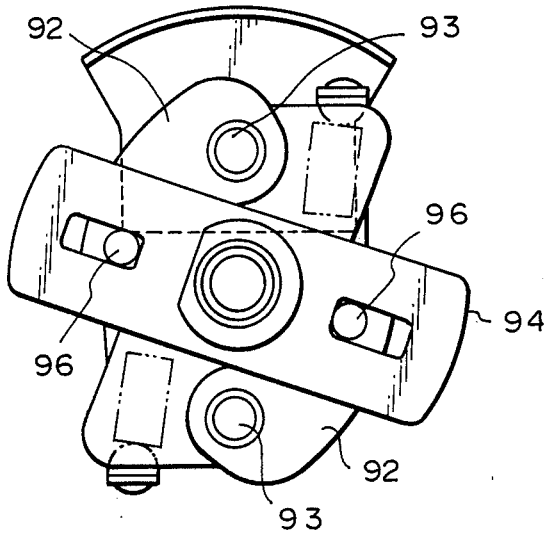
Fig. 3 (PRIOR ART)
FIG. 3 is a plane view of a conventional centrifugal spark-advance controller that includes the reluctor illustrated in FIG. 2.
Figure 5:
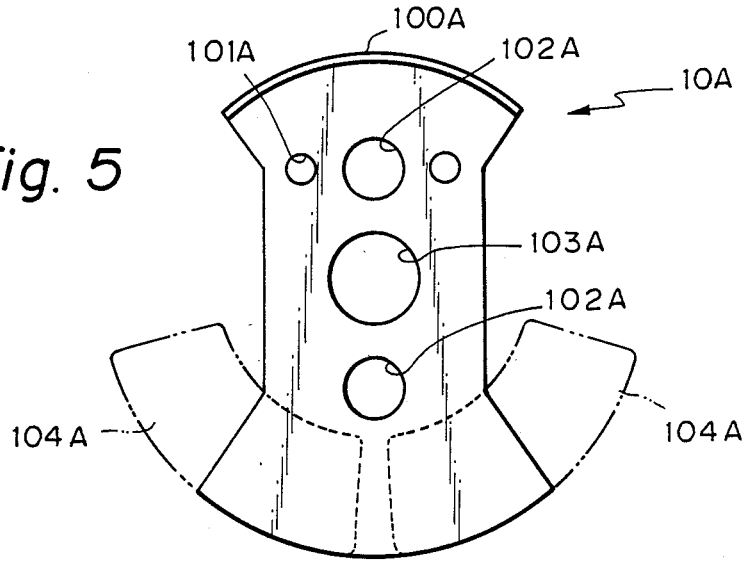
FIG. 5 is a plane view of a reluctor for discriminating between the cylinders of an internal combustion engine for use in an ignition distributor in accordance with this invention.
Figure 6:
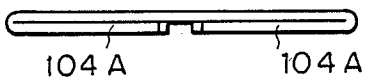
FIG. 6 is an end view of a reluctor used in an ignition distributor as illustrated in FIG. 5 as viewed from the end opposite the working end of the reluctor.

The ignition distributor in accordance with this invention differs from a conventional one in that a reluctor 10A shown in FIG. 5 for discriminating between the cylinders of an engine is provided in place of the reluctor 10 illustrated in FIG. 2. As can be clearly seen from a comparison between the one shown in FIG. 5 and the one shown in FIG. 2, the reluctor 10A has a more elongated shape than that of the reluctor 10. The elongated reluctor 10A has openings 101A through which the rivets 50 extend to fix the reluctor 10A to the governor base 91, unloaded openings 102A through which the weight holding pins 95 extend to hold the weights 92 on the governor base 91, and an unloaded opening 103A through which the shaft 3 passes loosely. The reluctor 10A has tabs 104A at the end opposite the working end 100A and, as shown in FIG. 5, the tabs 104A are folded so that the opposite end of the reluctor has the shape of a fan. The opposite end having the shape of a fan cancels the centrifugal force acting on the mass of the working end 100A while rotating, that is, the gravity center of the reluctor 10A is located exactly on the rotational axis of the shaft 3. This makes sure that the rotational movement of the shaft 3 is concentrated and wear of the bearings is therefore reduced. It may also be possible to stick a weight to the side opposite the working end 100A in order to assist in concentrating the rotational movement.

Figure 7:
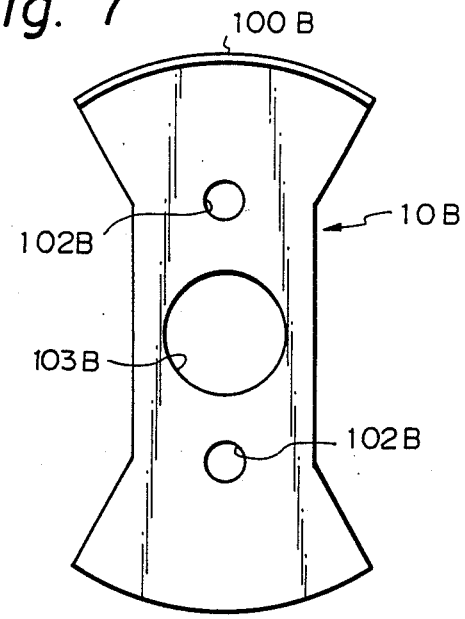
FIG. 7 is an plane view of another embodiment of a reluctor in accordance with this invention for discriminating between the cylinders of an internal combustion engine.

Shown in FIG. 7 is a reluctor of another embodiment in accordance with this invention.

Figure 8:
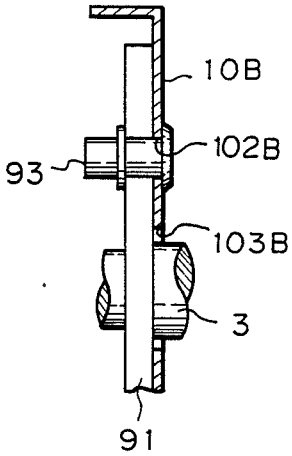
FIG. 8 is a fragmentary side view of the reluctor illustrated in FIG. 7 in the state of being attached to a governor base.

This reluctor 10B for discriminating between the cylinders of an internal combustion engine has openings 102B which are smaller in diameter than the openings 102A of the first embodiment as illustrated in FIG. 5. The weight holding pins 93 extend through these openings 102B to fix the reluctor 10B to the governor base 91 together with the weights 92, as shown in FIG. 8. The reluctor 10B also has an unloaded opening 103B which allows the shaft 3 to loosely pass therethrough.

In this embodiment, no rivets are needed to fix the reluctor to the governor base 91. This results in a reduced number of parts and, hence, a lower production cost.

Figure 9:
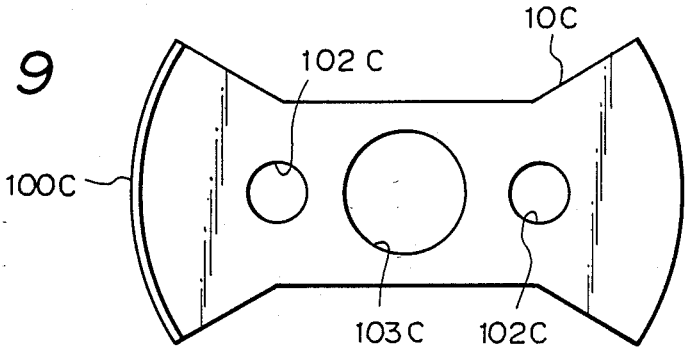
FIG. 9 is a plane view of another embodiment of a reluctor in accordance with this invention for discriminating between the cylinders of an internal combustion engine.

Another embodiment of a reluctor in accordance with this invention is shown in FIG. 9.

Figure 10:
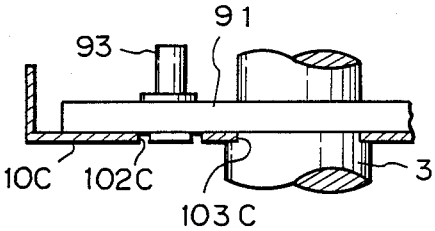
FIG. 10 is a fragmentary side view of the reluctor illustrated in FIG. 9 in the state of being attached to a governor base.

This reluctor 10C for discriminating between the cylinders of an internal combustion engine has unloaded openings 102C through which the weight holding pins 93 are loosely passed, and an opening 103C into which the shaft 3 is press-fitted. Thus the reluctor 10C is press-fitted on the shaft 3 and is caulked thereto together with the governor base 91 as shown in FIG. 10.

In this embodiment too, no rivets are needed to fix the reluctor to the governor base 91, which again results in a reduction in the number of parts and a lower production cost.

Although the present invention has been described through specific terms, it should be noted that the illustrated embodiments are not necessarily exclusive and various changes and modifications may be imparted thereto without departing from the scope of the invention which is limited solely by the appended claims.

What is claimed is:

1. An ignition distributor for an internal combustion engine comprising a shaft rotated by said engine, a reluctor for discriminating between the cylinders of an engine that is adapted to rotate in response to the rotation of said shaft, and a sensor cooperating with said reluctor to generate a signal for discriminating between the cylinders of said engine;

said ignition distributor characterized in that the gravity center of said reluctor is located on the rotational axis of said shaft;

said reluctor being an elongated reluctor having one end associating with said sensor to generate said signal, the other end of said reluctor having the shape of a fan so that the two ends balance each other, wherein said fan-shaped end has at least one folded portion.

2. An ignition distributor for an internal combustion engine comprising:

a shaft rotated by said engine;

a reluctor for discriminating between the cylinders of an engine that is adapted to rotate in response to the rotation of said shaft;

a sensor cooperating with said reluctor to generate a signal for discriminating between the cylinders of said engine; and a centrifugal spark-advance controller including a governor base fixed to said shaft and supporting said reluctor, and weights carried on said governor base by means of weight holding pins extending through said governor base;

said ignition distributor characterized in that said reluctor is fixed to said governor base by said weight holding pins.

3. An ignition distributor as claimed in claim 2, wherein the gravity center of said reluctor is located on said the rotational axis of said shaft.

4. An ignition distributor for an internal combustion engine comprising:

a shaft rotated by said engine;

a reluctor for discriminating between the cylinders of an engine that is adapted to rotate in response to the rotation of said shaft;

a sensor cooperating with said reluctor to generate a signal for discriminating between the cylinders of said engine; and a centrifugal spark-advance controller including a governor base fixed to said shaft and supporting said reluctor, and weights provided on said governor base by means of weight holding pins extending through said governor base;

said ignition distributor characterized in that reluctor is caulked to said shaft with said governor base.

5. An ignition distributor as claimed in claim 4 wherein the gravity center of said reluctor is located on said the rotational axis of said shaft.

* * * * *